US006443456B1

(12) United States Patent
Gajor

(10) Patent No.: US 6,443,456 B1
(45) Date of Patent: Sep. 3, 2002

(54) METHOD OF PLAYING A VIDEO POKER GAME WITH A MULTIPLE WINNING HAND PARLAY WAGERING OPTION

(75) Inventor: Frank Gajor, Livonia, MI (US)

(73) Assignee: B.I.U. Systems, LLC, Livonia, MI (US)

( * ) Notice: Subject to any disclaimer, the term of this patent is extended or adjusted under 35 U.S.C. 154(b) by 0 days.

(21) Appl. No.: 09/702,171

(22) Filed: Oct. 30, 2000

Related U.S. Application Data

(60) Provisional application No. 60/163,475, filed on Nov. 3, 1999.

(51) Int. Cl.[7] ..... A63F 1/00; A63F 9/20; A63F 13/60; A63F 9/24; G06F 17/00

(52) U.S. Cl. ..... 273/303; 463/16

(58) Field of Search ..... 273/274, 271, 273/273, 303; 463/1, 17, 16, 19, 20

(56) References Cited

U.S. PATENT DOCUMENTS

| | | | | | |
|---|---|---|---|---|---|
| 4,948,134 | A | * | 8/1990 | Suttle et al. | 273/85 CP |
| 5,022,653 | A | * | 6/1991 | Suttle et al. | 273/85 CP |
| 5,042,818 | A | * | 8/1991 | Weingardt | 273/292 |
| 5,100,137 | A | * | 3/1992 | Fulton | 273/85 CP |
| 5,167,413 | A | * | 12/1992 | Fulton | 273/85 CP |
| 5,251,897 | A | * | 10/1993 | Fulton | 273/85 CP |
| 5,411,257 | A | * | 5/1995 | Fulton | 273/85 CP |
| 5,531,441 | A | | 7/1996 | Dabrowski et al. | 463/12 |
| 5,531,448 | A | * | 7/1996 | Moody | 273/292 |
| 5,732,950 | A | | 3/1998 | Moody | 273/292 |
| 5,795,225 | A | | 8/1998 | Jones et al. | 463/13 |
| 5,823,873 | A | * | 10/1998 | Moody | 273/292 |
| 5,839,731 | A | | 11/1998 | Feola | 273/292 |
| 5,851,147 | A | | 12/1998 | Stupak et al. | 463/13 |
| 5,868,392 | A | | 2/1999 | Kraft | 273/292 |
| 5,951,011 | A | | 9/1999 | Potter et al. | 273/292 |
| 6,007,066 | A | * | 12/1999 | Moody | 273/292 |
| 6,048,267 | A | | 4/2000 | Wichinsky | 463/13 |
| 6,098,985 | A | | 8/2000 | Moody | 273/292 |
| 6,135,453 | A | * | 10/2000 | Srichayaporn | 273/292 |
| 6,170,827 | B1 | * | 1/2001 | Lombardo et al. | 273/274 |
| 6,322,445 | B1 | * | 11/2001 | Miller | 273/293 |

* cited by examiner

*Primary Examiner*—Paul T. Sewell
*Assistant Examiner*—Alvin A. Hunter
(74) *Attorney, Agent, or Firm*—Kevin J. Snyder, Esq.

(57) ABSTRACT

The method of the present invention involves card games in which the player plays multiple hands of cards during one play session. The cards are dealt out in horizontal fashion and may include three card, five card, seven card or higer card games. The player may wager on each horizontal row of cards dealt separately and each row of cards will be played as a separate poker game. The player may also make a separate wager (Parlay Wager) that will payoff if multiple winning hands are obtained in one play session. Additional versions of the game also provide for additional wagering. For example in a three card three hand game, the horizontal dealing of the cards are such that each row of cards are situated in sequential order so that first hand is directly over the second hand and the second hand is directly over the third so that a three card by three card matrix is created. In addition to having the ability to wager and win the three hands drawn in horizontal fashion and the parlay wager for multiple winning hands, the player also has the ability to win five additional ways (i.e., three vertical paylines and two diagonal combinations paylines).

8 Claims, 5 Drawing Sheets

METHOD OF PLAYING A VIDEO POKER GAME WITH A MULTIPLE WINNING HAND PARLAY WAGERING OPTION

CROSS REFERENCE TO RELATED APPLICATIONS

This application is entitled to the benefit of Provisional Patent Application Ser. No. 60/163,475 filed Nov. 3, 1999 entitled "METHOD OF PLAYING A THREE CARD VIDEO POKER GAME WITH MULTIPLE HORIZONTAL, VERTICAL AND DIAGONAL PLAY HANDS ALONG WITH A PERFECT DRAW POKER OPTION"

BACKGROUND

1. Field of Invention

This invention relates primarily to electronic video poker games, and more particularly to electronic video poker games that allow for multiple poker hands to be played at the same time and in tandem and allows the player to bet on multiple poker hands and provides additional payouts based upon multiple winning hands. The invention has many versions with a common thread being that a player will have additional opportunities to play multiple poker hands and obtain a higher payoff if multiple winning hands are obtained during one play session. The invention also involves features that may be applied to casino table games.

2. Discussion of Prior Art

Video poker games have long been used by casinos and gaming establishment as an additional gaming entertainment within their properties. Video poker games have become extremely popular over the years. It has also become common practice in the gaming establishments to have video poker games that allow the player to play multiple poker hands during one play session. The player makes a wager for each row of cards dealt to the player separately and each row of cards becomes a separate hand to be played by the player. These games allow the player to bet on each hand separately and pay out on each winning hand obtained. The advantage of these games is that it allows the player to play more poker hands in a shorter period of time. For example, U.S. Pat. No. 6,098,985 to Moody (2000) discloses the ability to play multiple poker hands during one play session; however, when it comes to the payout, each winning hand is considered mutually exclusive from each other (i.e., you obtain no additional benefit or payout if you obtain multiple winning hands during one play session). U.S. Pat. No. 5,531,441 to Dabrowski et al. (1996) discloses a method of playing double poker were two distinct poker hands are dealt to the player and an additional payoff is provided if certain cards from the first hand matches cards from the second hand; however, then only one hand is chosen to complete the game. U.S. Pat. No. 6,048,267 to Wichinsky (2000) discloses a method of playing multiple hand stud poker whereby three or more hands can be played at the same time; however, the player does not have an option to make an additional bet (parlay bet) that would pay out higher odds compared to the standard single hand payoff if multiple winning hands are obtained. While several poker games have been disclosed in the prior art that allows for exotic, progressive and additional wagering: U.S. Pat. No. 5,868,399 to Kraft (1999), U.S. Pat. No. 5,951,011 to Potter et al. (1999), and U.S. Pat. No. 5,839,731 to Feola (1998) respectively, the prior art only discloses horizontal poker hands and does not disclose the idea of having additional poker hands using vertical and diagonal hands and, therefore, additional paylines.

It is an object of the present invention to provide a higher payout for players who obtain multiple winning poker hands during the same play session by providing the player the ability to bet a parlay option whereby higher odds are given if multiple winning hands are achieved.

It is a feature of the present invention to increase the number of poker hands being played during one play session by allowing for horizontal, vertical and diagonal hands to be played as the cards are situated in a matrix (i.e., 3×3 card, 5×5 card, or 7×7 card matrix).

It is a further object of the present invention to provide a player the ability to play a perfect play option when drawing cards during draw poker version that gives the player the highest probability of obtaining a winning hand.

It is an additional object of the invention to provide the player the ability to play more poker hands in a shorter period of time and, therefore, have the potential of winning more often in the same period of time from the traditional video poker games.

It is an additional object of the invention to allow the player to choose to play from a single deck of 52 cards or multiple decks with or without wildcards.

SUMMARY OF THE INVENTION

The game of the present invention is displayed on an electronic video gaming machine. Depending on the machine and game chosen, the player is given the option to play stud poker or draw poker that is played using either a single fifty-two-card deck of playing cards or multiple decks. The player also has the option to choose to use wild cards. The present invention includes a variety of poker games all of which include playing two or more poker hands during one play session. These games include three card, five card, seven card or even higher card games. The cards are dealt in traditional horizontal fashion and the player has the option of wagering on each individual hand separately and can choose to also place an additional wager (parlay wager) that will pay out separately if multiple winning hands are obtained during the same play session. The player may also have the option of winning additional payouts for obtaining winning hands on vertical and diagonal play hands.

DETAILED DESCRIPTION AND OPERATION OF THE PREFERRED EMBODIMENTS

Figure 1:
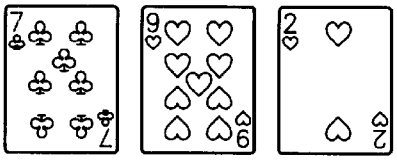
FIG. 1 shows the video monitor display of version #1 of the present invention after the initial deal of cards.

The present invention includes a variety of video poker games. Each version of the video poker game is designed to be played by displaying cards from a conventional deck of cards (plus wildcards if desired) on a video monitor to a player. The player is given the option to play stud poker or draw poker. If stud poker is chosen, the player is not allowed to draw any new cards after the initial deal of cards. If draw poker is chosen, the player is given the option to discard all, some or none of the initial dealt cards and draw new cards in the place of the discarded cards. In all versions of the game, the player also has the option of selecting whether wild cards and/or joker cards that will be used during the game. If the player selects the wild card option, the video poker device will identify to the player on the monitor which type of cards will be considered wild cards. If the player selects the joker card option, the video poker device monitor will indicate that joker cards are in use. The video poker device will use the wild cards and joker cards in such a way as to ensure that the player has the highest value (i.e., version #2 through #5), a single deck or multiple decks of 52 cards may be used.

The object of the game is for the player to obtain a combination of cards (i.e., hand) that match hands that have been predetermined and pre-programmed into the video poker device. Hands that match such predetermined and pre-programmed hands will be considered winning hands. These winning hands include but are not limited to hands that have traditionally been considered of value in standard poker such as a pair (e.g., two-of-a-kind such as two queens), a straight (e.g., consecutive cards in a row such as three, four, five, six, and seven), flush (e.g., cards all of the same suit such as spades), straight-flush (e.g., consecutive cards in a row all of the same suit such as three of hearts, four of hearts, five of hearts, six of hearts and seven of hearts), three of a kind (e.g., three-of-a-kind such as three kings), full house (e.g., two-of-a-kind and three-of-a-kind in the same hand) and royal straight-flush (e.g., consecutive cards in a row all of the same suit which must be ten, jack, queen, king, ace). As in traditional poker, the value of the hand is based upon the difficulty of obtaining that hand which is based upon the probability of obtaining that hand. The more difficult the hand is to obtain, the higher the value and the higher the odds that will be paid to a player who draws that particular winning hand.

The present invention has an additional feature called the perfect play option that can only be used when the player chooses the draw poker option. When the player selects the perfect play option, the video poker machine will automatically determine which cards the player will discard and which cards the player will keep and then automatically holds and/or draws new cards for the player. The perfect play option is designed to speed up play by having the video poker machine pick the cards. The player should keep in order for the player to have the best probability of obtaining a winning hand. The perfect play option program is based upon the standard probability calculations and generally accepted methods of play in the gaming industry as being the best way a certain hand should be played in order to give you the highest probability of winning.

Figure 7:
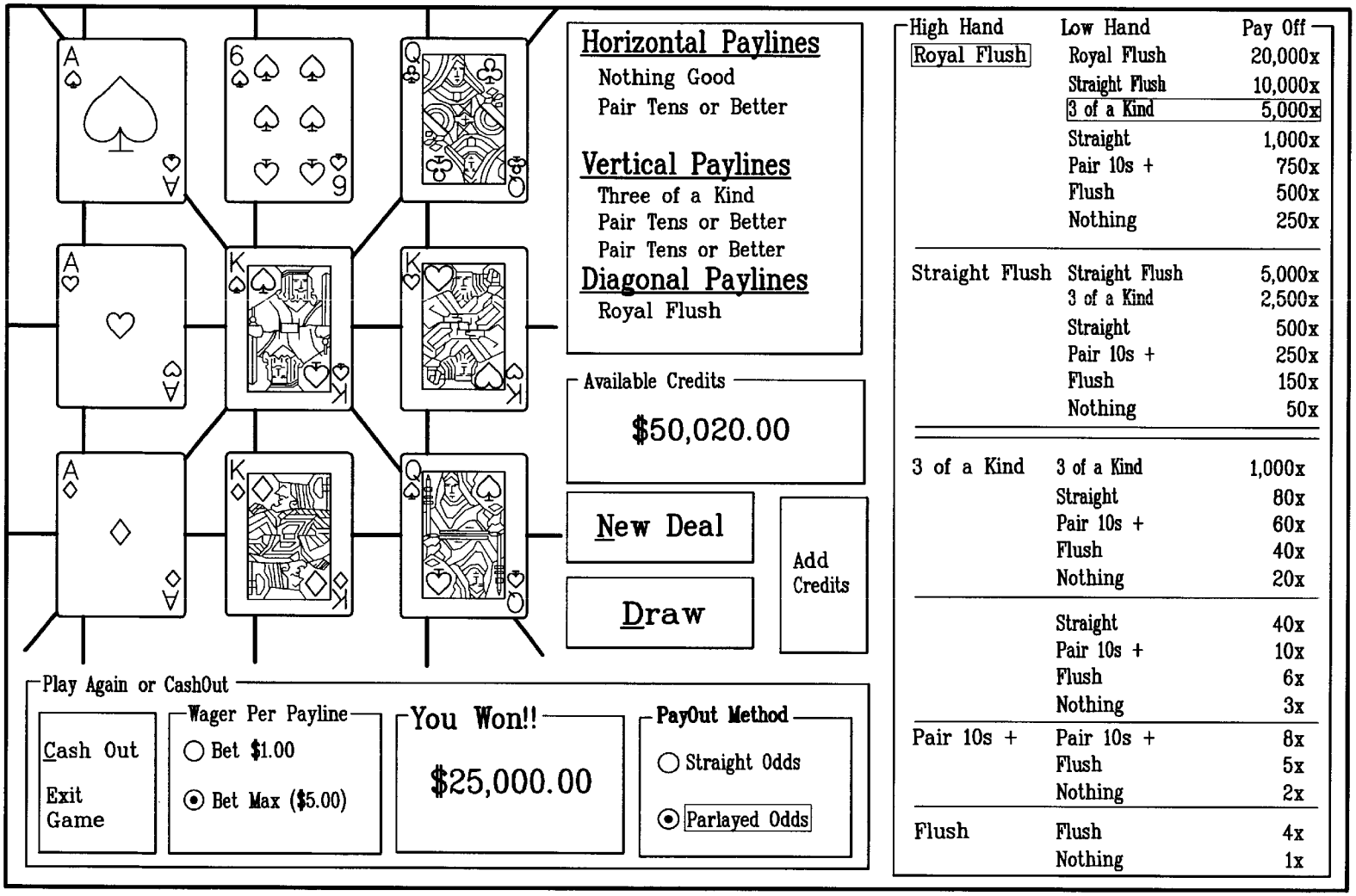
FIG. 7 shows the monitor display of version #4 of the present invention and displaying the parlay payoff odds when taking into account the multiple hands.

The present invention also has an additional feature called the parlay option, which is only available for multiple hand versions of the game (i.e., version #2 through #5). The parlay option that the player normally, but not necessarily, choose prior to drawing his hands, provides the player the ability to obtain a larger payoff by combining multiple winning hands. As shown in FIG. 7, the payoff odds under the parlay option are much higher than if the player was to only choose the straight payoff which means he would only get paid the standard payoff for each winning hand.

Version #1—Three Card Horizontal Poker

Figure 2:
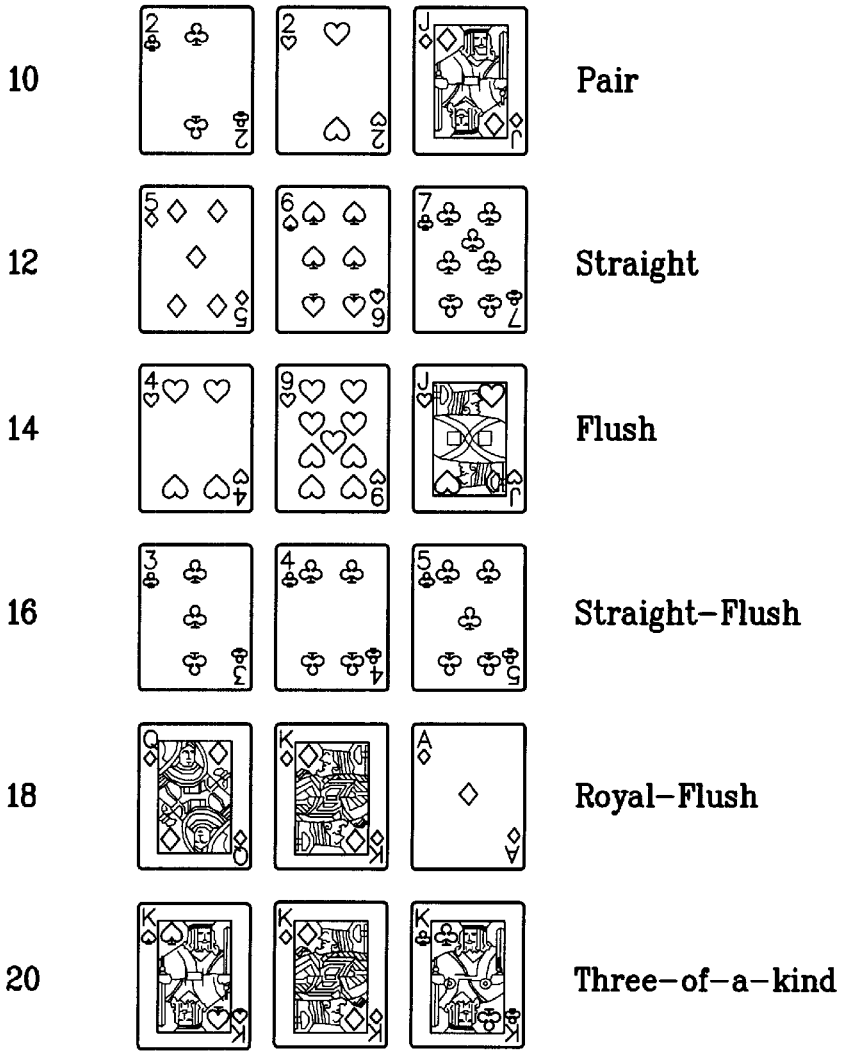
FIG. 2 shows examples of the types of winning hands allowed in three card poker.

In version #1 of the invention, the player is dealt a single three card hand face-up. In the preferred embodiment, the player makes a wager prior to having the cards dealt. FIG. 1 gives an example of how the monitor displays the cards. If the player selects the stud poker game, the video poker device will automatically compare the hand dealt to the player to the predetermined winning hands programmed into the video poker device. FIG. 2 gives examples of the type of hands which are typically considered winning hands including a pair (10), straight (12), flush (14), straight flush (16) and royal straight flush (18) and three of a kind (20). If the player's hand corresponds to one of these predetermined and pre-programmed winning hands, the video poker device will notify the player that he is a winner by paying the player a monetary value based upon the odds assigned and amount bet or giving him credits to play additional games. If the player selects the draw poker game, the player is given the option to keep certain cards by manipulating the monitor to draw new cards in place of the cards not held by pushing the draw button. If the player selects the perfect play option, the video poker device will automatically determine which cards the player will discard and which cards the player will keep and then automatically draw new cards for the player.

After drawing new cards, the video poker device automatically compares the hand the player has to predetermined winning hands pre-programmed into the video poker device. If the player's hand corresponds to one of these predetermined winning hands, the video poker device will notify the player that he is a winner by paying the player a monetary value based upon the odds assigned and amount bet or giving him credits to play additional games.

Version #2—Dual Hand Poker

Figure 3:
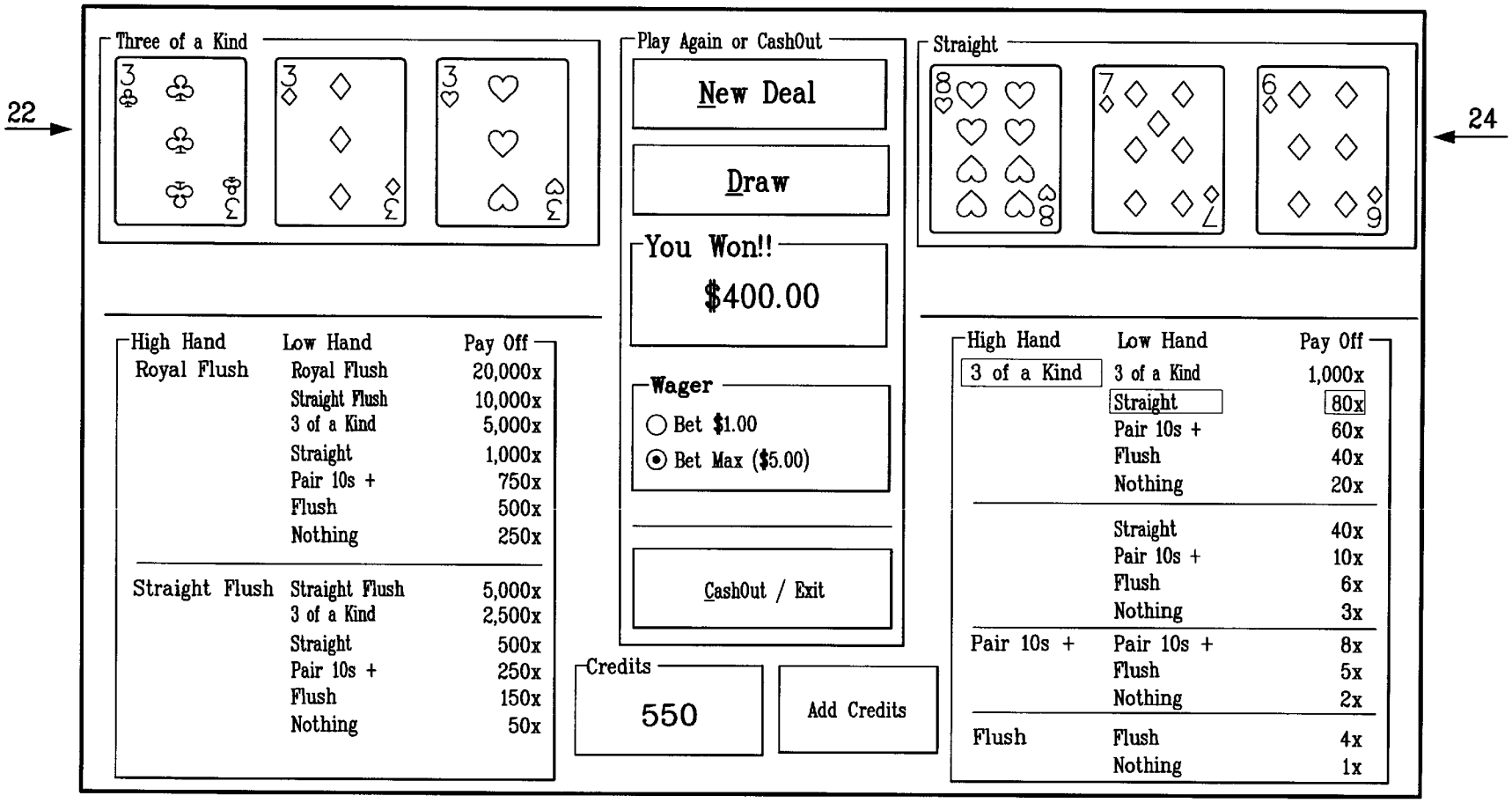
FIG. 3 shows the monitor display of version #2 of the present invention and displaying the parlay payoff odds when taking into account the dual hands.

Version #2 of the invention is a game similar to version #1 identified above, however, two (2) or more horizontal rows of three cards each are initially dealt to the player face-up and displayed on the video monitor. FIG. 3 shows the monitor display for this game that shows two separate three card hands being dealt. Hand one (22) displays three threes and hand two (24) displays a straight (i.e., six, seven, and eight). In the preferred embodiment, the player makes a wager prior to the cards being dealt. The game is then played exactly the way version #1 identifies play, however, if the player selects the parlay option, the payoff will be combined so that if a player that draws winning hands on both paylines (i.e., 22 and 24) he will obtain larger odds and as a result will win more money than a player who selects the straight payoff option which only pays out the normal payoff for each winning hands of three threes (22) and a straight (24) (e.g., pay's eighty (80) to one (1) odds). The player also has the option of only playing the parlay option alone or not playing the parlay option.

Version #3—Multiple Hand Horizontal Poker

Figure 4:
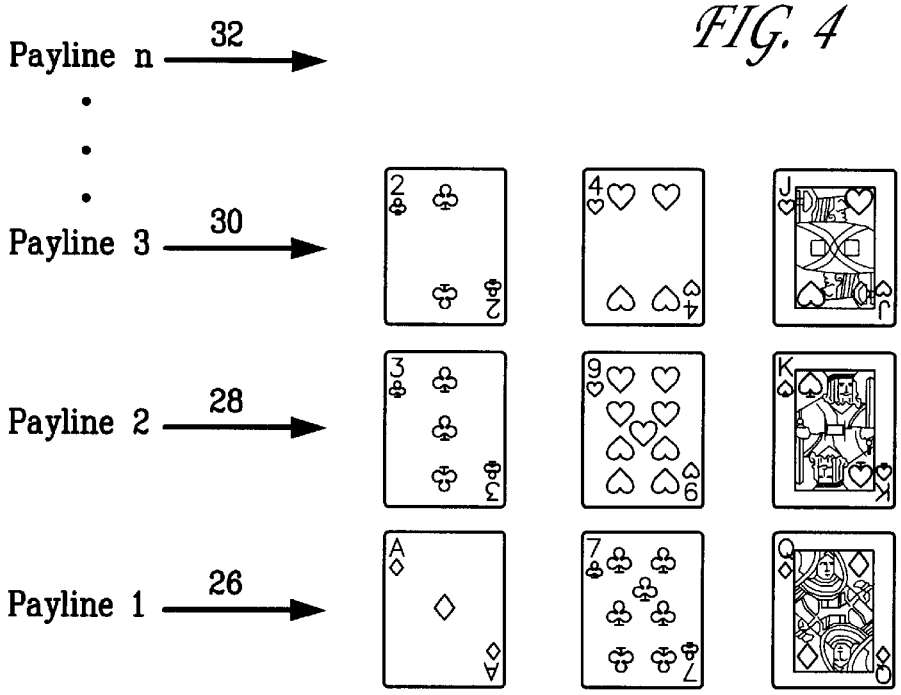
FIG. 4 shows the video monitor display of version #3 of the present invention after the initial deal of cards.

Version #3 of the invention is a game similar to version #1 identified above, however, two (2) or more horizontal rows of three cards each are initially dealt to the player face-up and displayed on the video monitor. FIG. 4 shows the monitor display for this game which shows multiple three card hands dealt. Payline 1 (26) shows hand one, payline 2 (28) identifies hand two, payline 3 (30) identifies hand three while payline n (32) identifies additional hands (n being the number of hands dealt) that are dealt. In the preferred embodiment, the player makes a wager on each payline prior to the card being dealt. The game is then played exactly the way version #1 identifies play, however, if the player selects the parlay option, the payoff will be combined so that if a player that draws winning hands on more than one payline (e.g., 26, 28, 30, 32 and etc.) he will obtain larger odds and as a result will win more money than a player who selects the straight payoff option which only pays out the normal payoff for each winning hand. The player also has the option of only playing the parlay option alone or not playing the parlay option.

Version #4—Horizontal, Vertical and Diagonal Poker

Figure 5:
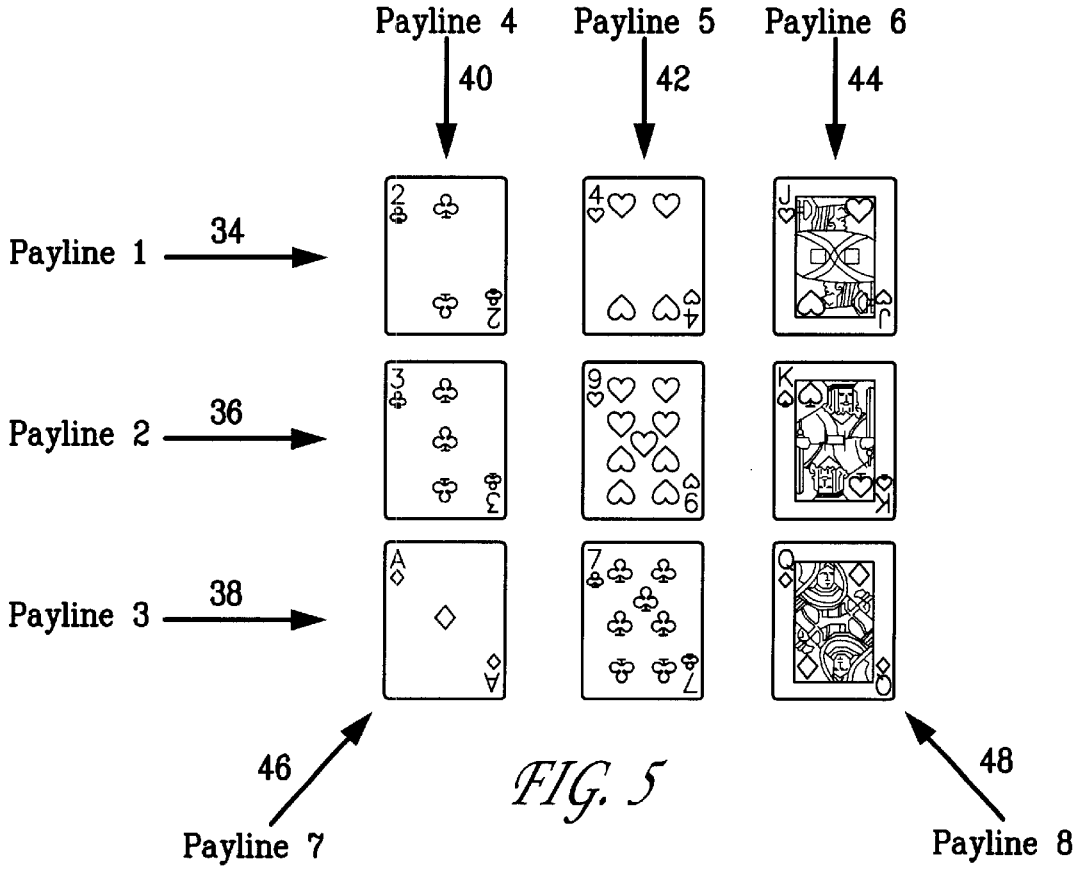
FIG. 5 shows the video monitor display of version #4 of the present invention after the initial deal of cards.

Version #4 of the invention is similar to version #3, however, exactly three horizontal rows of three cards each are initially dealt to the players face-up and displayed on the video monitor. FIG. 5 shows the monitor display for this version of the game. The second (36) and third (38) hands are aligned card for card over the first hand (34). This version of the game creates 8 hands; three horizontal hands (payline 1 (34), payline 2 (36) and payline 3 (38); three vertical hands (payline 4 (40), payline 5 (42), payline 6 (44); and two diagonal hands (payline 7 (46) and payline 8 (48)). The player then plays the game exactly the way version #1 identifies it, however, if the player selects the parlay option the payoff will be combined so that if a player that draws winning hands on multiple paylines he will obtain larger odds and as a result will win more money than a player who selects the straight payoff option which only pays out the normal payoff for each winning hand. FIG. 7 shows the type of payoff the player will receive if the player chooses the parlay option. The player also has the option of only playing the parlay option alone or not playing the parlay option.

Version #5—Five Card Horizontal, Vertical and Diagonal Poker

Figure 6:
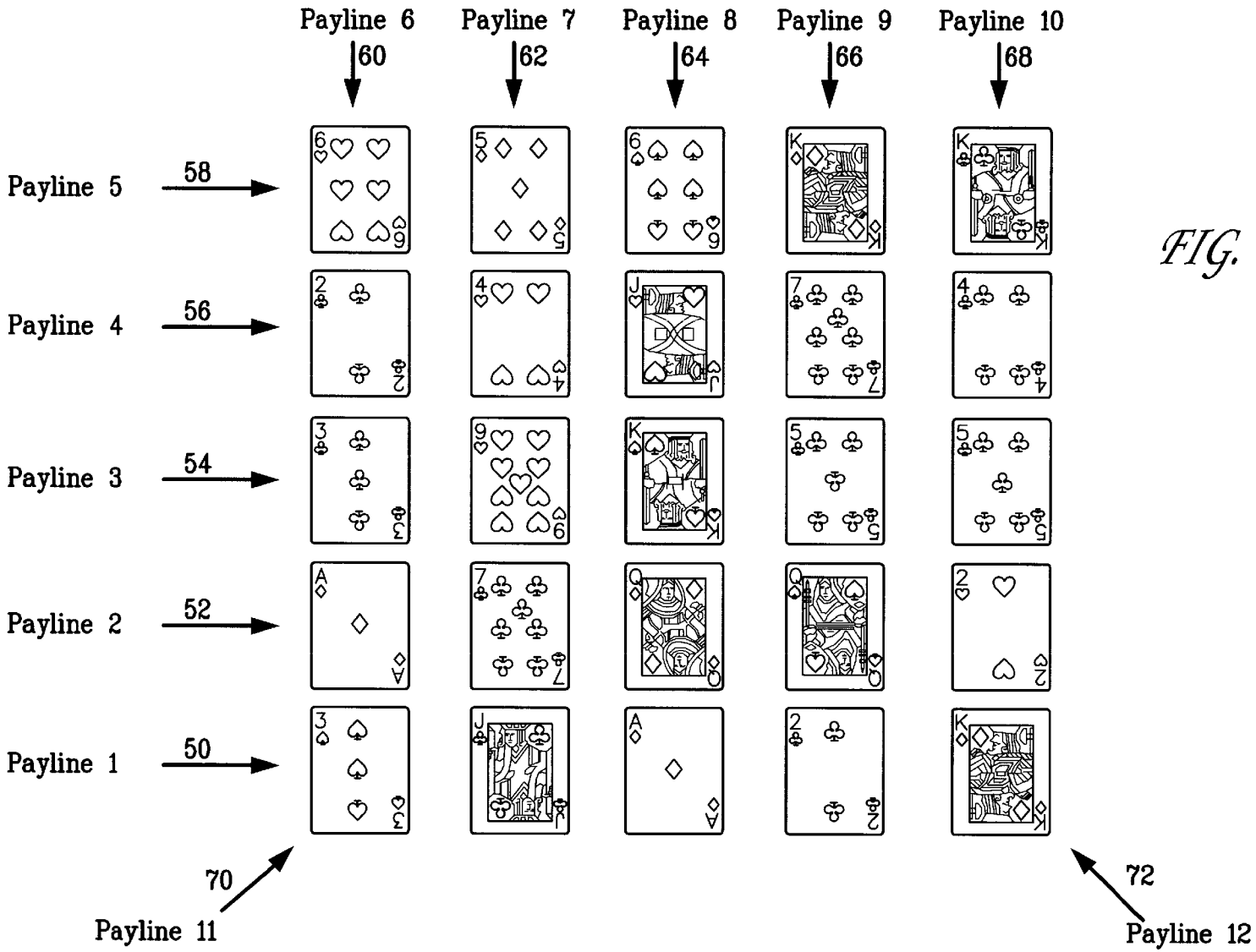
FIG. 6 shows the video monitor display of version #5 of the present invention after the initial deal of cards.

Version #5 of the invention is similar to version #4, however, exactly five horizontal rows of five cards each are initially dealt to the players face-up and displayed on the video monitor. FIG. 6 shows the monitor display for this version of the game. This version of the game creates 12 hands; five horizontal hands (payline 1 (50), payline 2 (52), payline 3 (54), payline 4 (56), payline 5 (58)); five vertical hands (payline 6 (60), payline 7 (62), payline 8 (64), payline 9 (66), and payline 10 (68)); and two diagonal hands (payline 11 (70) and payline 12 (72)). The player then plays the game exactly the way version #1 identifies it, however, if the player selects the parlay option the payoff will be combined so that if a player that draws winning hands on the multiple paylines he will obtain larger odds and as a result will win more money than a player who just wins more than one hand on the straight version. Version #5 can be expanded to seven cards and seven hands, nine cards by nine hands or even higher combinations. The player also has the option of only playing the parlay option alone or not playing the parlay option.

CONCLUSIONS, RAMIFICATION AND SCOPE OF INVENTION

Thus the reader will see that the poker game invention provides additional and significant features that the current prior art is lacking. The invention rewards players who obtain multiple winning hands by receiving a higher payout. This is very attractive to video poker players since it gives them an incentive to play multiple hand play sessions.

While my above description contains many specificities, these should not be construed as limitations on the scope of the invention, but rather as an exemplification of one of preferred embodiment thereof. Many other variations are possible.

Accordingly, the scope of the invention should be determined not by the embodiment(s) illustrated, but by the appended claims and their legal equivalents.

What is claimed is:

1. A method of playing a poker game using a standard deck of poker playing cards comprising:

(a) a player making a first wager for the first hand and a second wager for the second hand;

(b) a player making a third wager, which is called a parlay wager, based upon if the resulting cards of the first hand comprise a predetermined poker hand ranking and if the resulting cards of the second hand comprises a predetermined poker hand ranking;

(c) dealing three cards face-up comprising the first hand and dealing three cards face-up comprising the second hand;

(d) selecting none, one, or more of the face-up cards from the first hand as cards to be held;

(e) discarding from the first hand the cards that were not selected to be held and replacing each of these cards with another card from the deck of cards;

(f) determining the poker hand ranking of the resulting cards of the first hand;

(g) selecting none, one, or more of the face-up cards from the second hand as cards to be held;

(h) discarding from the second hand the cards that were not selected to be held and replacing each of these cards with another card from the deck of cards;

(i) determining the poker hand ranking of the resulting cards of the second hand;

(j) paying the player a pre-established amount based on the amount of the parlay wager if the resulting cards of the first hand comprise a predetermined poker hand ranking and if the resulting cards of the second hand comprise a predetermined poker hand ranking.

2. The method of claim 1 in which five cards are dealt face-up for the first and second hands.

3. The method of claim 1 in which seven cards are dealt face-up for the first and second hands.

4. The method of claim 1 in which no cards can be drawn after the initial dealing in the first and second hands.

5. A method of playing a poker game using a standard deck of poker playing cards comprising:

(a) a player making a first wager for the first hand, a second wager for the second hand, and a third wager for the third hand;

(b) a player making a fourth wager, which is called a parlay wager, based upon if the resulting cards of the first hand comprise a predetermined poker hand ranking and if the resulting cards of the second hand comprise a predetermined poker hand ranking and if the resulting cards of the third hand comprise a predetermined poker hand ranking;

(c) dealing three cards face-up comprising the first hand, dealing three cards face-up comprising the second hand directly below the first hand, and dealing three cards face-up comprising the third hand directly blow the second hand creating a three by three card matrix;

(d) selecting none, one or more of the face-up cards from the first hand as cards to be held;

(e) discarding from the first hand the cards that were not selected to be held and replacing each of these cards with another card from the deck of cards;

(f) determining the poker hand ranking of the resulting cards of the first hand;

(g) selecting none, one or more of the face-up cards from the second hand as cards to be held;

(h) discarding from the second hand the cards that were not selected to be held and replacing each of these cards with another card from the deck of cards;

(i) determining the poker hand ranking of the resulting cards of the second hand;

(j) selecting none, one or more of the face-up cards from the third hand as cards to be held;

(k) discarding from the third hand the cards that were not selected to be held and replacing each of these cards with another card from the deck of cards;

(l) determining the poker hand ranking of the resulting cards of the third hand;

(m) paying the player a pre-established amount based on the amount of the parlay wager if the resulting cards of the first hand, second hand and third hand all comprise a predetermined poker hand ranking.

6. The method of claim 5 in which eight hands, three horizontal, three vertical and two diagonal from the three by three card matrix, are used to determine the parlay wager payment.

7. The method of claim 5 in which five cards and five hands are dealt in consecutive horizontal order and 12 hands (five vertical, five horizontal and two diagonal from the five by five card matrix) are used to determine the parlay wager payment.

8. The method of claim 5 in which seven cards and seven hands are dealt in consecutive order and 16 poker hands (seven horizontal, seven vertical and two diagonal from the seven by seven card matrix) are used to determine the parlay wager payment.

* * * * *